US005765284A

United States Patent [19]

Ali et al.

[11] Patent Number: 5,765,284

[45] Date of Patent: Jun. 16, 1998

[54] METHOD FOR CONSTRUCTING HEAT EXCHANGERS USING FLUIDIC EXPANSION

[75] Inventors: Amer F. Ali; Kenneth P. Gray, both of East Syracuse; Daniel P. Gaffaney, Chittenango, all of N.Y.

[73] Assignee: Carrier Corporation, Syracuse, N.Y.

[21] Appl. No.: 771,999

[22] Filed: Dec. 23, 1996

[51] Int. Cl.[6] ..... B23P 15/26

[52] U.S. Cl. ..... 29/890.047; 29/890.044; 29/727

[58] Field of Search ..... 29/890.043, 840.052, 29/890.047, 523, 727, 723; 228/183

[56] References Cited

U.S. PATENT DOCUMENTS

| | | | |
|---|---|---|---|
| 3,780,799 | 12/1973 | Pasternak | 29/840.047 |
| 3,849,854 | 11/1974 | Mattioli et al. | 29/890.047 |
| 4,365,667 | 12/1982 | Hatada et al. | 165/152 |
| 4,649,492 | 3/1987 | Sinha et al. | 29/840.044 |
| 4,649,493 | 3/1987 | Castner et al. | 29/890.044 |
| 5,210,932 | 5/1993 | Tokura | 29/727 |

*Primary Examiner*—Irene Cuda

[57] ABSTRACT

A method of manufacturing a heat exchanger using fluidic expansion, the heat exchanger having tubing sections interconnected to form at least one circuit for transporting a first heat transfer fluid and conductive fins secured to the circuit for increasing the surface area thereof and increasing the heat transfer between the first fluid and a second fluid flowing among the fins. The tubing sections are positioned in a predetermined manner and the fins are disposed therewith and along the length thereof. The inlets and outlets of the tubing sections are then interconnected to form said the fluid circuit. Next, the fins are secured in place so as not become damaged during the sealing of the interconnections, which follows immediately thereafter. Finally, the entire circuit is expanded to enmesh said fins by enclosing the volume of the circuit and introducing an expansion fluid therein at a pressure which surpasses the tube yield strength of the tubing and causes the walls thereof to expand radially outward.

40 Claims, 4 Drawing Sheets

METHOD FOR CONSTRUCTING HEAT EXCHANGERS USING FLUIDIC EXPANSION

BACKGROUND OF THE INVENTION

1. Field of the Invention

The present invention relates to heat exchangers, and more specifically to a method of manufacturing heat exchangers utilizing fluid expansion.

2. Description of Related Art

Heat exchangers are well known for regulating the thermal content of a fluid flow. Typical heat exchanger configurations utilized in the heating, ventilating, and air conditioning (HVAC) industry consist essentially of conductive tubing formed into a circuit with several parallel sections and conductive fins interspersed therebetween in some fashion. The circuit transports a thermal fluid that can either draw heat from or impart heat to a second fluid flow stream propelled across the heat exchanger. The fins increase the surface area of the circuit which gets exposed to the fluid flowing across the heat exchanger, whereby the quantity of heat that may be transferred between the two fluids is increased.

In typical HVAC heat exchangers, refrigerant circuits are formed by taking straight portions of circular tubing (usually made of copper) and bending them in the middle so that they contain a "U" shaped bend, resembling a hairpin. The ends of these "hairpins" are then placed perpendicularly through preset bores in a flat piece of metal, called a tube sheet, which serves as a fixture for mounting the heat exchanger. Next, plate fins are placed on the hairpins in the same manner as the tube sheet. Plate fins are essentially flat and have bores corresponding to those on the tube sheet, but they are made of a much thinner and lighter material than the tube sheet.

After all of the fins are in place, a second tube sheet is similarly placed on the hairpins near the ends thereof. A "U" shaped endcap, or return bend, is secured on most of the ends of the tubes by a brazing process so as to complete the fluid circuit by forming a return path through the hairpins. Headers can then be mounted on the remaining exposed hairpin ends for facilitating the flow of the heat exchanging fluid into and out of the heat exchanger.

During the manufacture of a heat exchanger, the hairpins are expanded to ensure that the fins (and tube sheets) are securely fastened thereto and that the fins are integrally contiguous therewith. If the fins and tubes are not contiguous over a large enough portion of surface area the amount of heat transfer therebetween will be greatly diminished. The typical method for expanding the tubes is to use a mandrel to bore axially through the length of the tubes. Though this "mechanical" expansion does ensure that the tubes will be expanded very accurately to a desired diameter, there are several limitations to the process.

The first such limitation is that each of the straight portions of the tubes must be expanded individually because the mandrels cannot bore through hairpin turns. To offset this limitation, current mechanical expansion machines contain several rows of mandrels which expand all or most of the straight portions of the hairpins on a heat exchanger at one time. Due to the expense of these machines, one machine is typically re-tooled to expand many different sizes of tubing. Not only is it expensive to maintain a sufficient quantity of mandrels, but the re-tooling time required for fitting a single machine to expand tubes of different sizes can also be costly because it requires several man hours to complete.

A further limitation of mechanical expansion is that it affects the internal surface enhancements of heat exchanger tubing. It is common in the HVAC industry to alter the inner surface geometry of heat exchanger tubing, such as forming small channels or grooves thereon, in order to enhance the convection conductance of the tube. These "surface enhancements" are added to the tubing during its manufacture by forming the desired pattern on its inner surface. However, mechanical expansion physically drills the walls of the finished tubing outward, thereby permanently crushing these surface enhancements to some degree and correspondingly decreasing the efficiency of the tubes.

An additional limitation of the mechanical expansion process is the fact that this process results in lost materials. The lost materials are a result of the axial force of the mandrel which partially compacts the tube as it travels therethrough. To account for this axial shrinkage, approximately 2–4% more length must be initially added on to the tube beyond the final length, which amounts to a substantial portion of material as numerous heat exchanger units are manufactured. A final limitation is that only circular tubing can be used in the mechanical expansion process.

One method for overcoming these limitations is to utilize fluidic pressure to expand the tubes rather than mechanical mandrels. Such a fluidic expansion involves sealing the tubing and injecting a high pressure fluid therein until the internal pressure surpasses the material yield strength of the outer tubing walls, at which point the walls give way and expand radially outward. During such expansion the walls of the tubing may narrow slightly to offset the increasing diameter caused by the radially outward force.

In addition to overcoming the aforementioned limitations, a further advantage of fluid expansion is that leak and proof testing can be performed at the same time a heat exchanger is being expanded. Currently, leak and proof tests involve filling completed heat exchangers with a fluid at several hundred p.s.i. to ensure that they are safe for use with a pressurized heat transfer fluid. However, fluidic expansion will require pressurizing the tubing to 1000 or more p.s.i., so there would be no need to perform separate leak and proof testing since the rigors of fluidic expansion are much more stringent.

There have been attempts to use fluid expansion in the formation of heat exchangers. For instance, Huggins (U.S. Pat. No. 2,838,830) discloses such a process wherein a single piece of tubing is bent into a serpentine shape, flattened on its cross section, and then expanded fluidically to engage serpentine fins bonded to the flattened portions of the tubes to form secure contact therewith.

Though the Huggins process does teach a method for expanding a simple heat exchanger fluidically after its final assembly, it does not teach how to perform this process on the more complex heat exchangers currently in use. First, it could not be used to create the hairpin style heat exchangers utilized in the HVAC industry. One reason is that it does not teach the use of return bends, which are necessary to interconnect hairpin sections.

There are two main reasons for using hairpins with return bends rather than bending one long section of tubing several times, as Huggins requires. One is that with the large amounts of tubing used in modem HVAC heat exchangers, it would be impractical to bend a single piece of tubing of this length multiple times. The other reason for using hairpins is that they can be laced through plate fins. However, one single length of tubing could not be bent back and forth in such a manner that would accommodate plate fins.

One further limitation of the Huggins method with respect to hairpin style heat exchangers is that Huggins requires the tubing to be flattened on its cross section. As previously noted, surface enhancements are used in hairpin tubing to increase heat transfer, and these surface enhancements could be damaged by crushing the tubing into a flattened position.

Most of these same limitations of Huggins would also apply to the manufacture of automotive style heat exchangers. These heat exchangers are constructed by placing serpentine fins between individual pieces of rectangular tubing and interconnecting the tubing pieces with headers, which adapt the flow of heat transfer fluid from an external source to flow in and out of the tubing circuit. Here again, it would be impractical to bend one single piece of tubing, especially rectangular tubing, enough times to form such a tubing circuit. Additionally, Huggins teaches no method for assembling a heat exchanger with headers.

Jansson et al. (U.S. Pat. No. 4,970,770) teaches another method for manufacturing a heat exchanger that utilizes hydraulic expansion. Unlike Huggins, the heat exchanger described in Jansson et al. utilizes the return bends and plate fins common to current HVAC heat exchangers. However, Jansson et al. does not teach a method for expanding an assembled heat exchanger circuit. Jansson et al. provides only for the expansion of the tubing sections individually, which is how the fins are secured in place before the return bends are brazed on the exposed ends of the hairpins.

In order to expand an entire circuit, it is necessary to put the return bends on the exposed ends of the hairpins before expanding the tubing. However, return bends are typically affixed to the tubing by brazing, which uses a high heat source to bond the return bends and tubing together. Yet, if the fins have not been secured before the heat exchanger is subjected to brazing, the fins are likely to become damaged. Since Jansson et al. teaches no method for securing the fins other than expansion of the individual sections, it follows that expansion after final assembly is not possible by this method. Accordingly, the additional step of leak and proof testing cannot be avoided.

This same limitation would occur in the manufacture of the automotive style heat exchanger, mentioned above, according to the Jansson et al. method.

SUMMARY OF THE INVENTION

One object of the present invention is to provide a method for manufacturing a heat exchanger which overcomes the limitations associated with the mechanical expansion process. A further object of the present invention is to provide a method for manufacturing a heat exchanger that allows for expansion after the final assembly thereof.

According to the present invention, a method of manufacturing a heat exchanger using fluidic expansion, the heat exchanger having tubing sections interconnected to form at least one circuit for transporting a first heat transfer fluid and conductive fins secured to the circuit for increasing the surface area thereof and increasing the heat transfer between the first fluid and a second fluid flowing among the fins is provided. The method comprises positioning the tubing sections in a predetermined manner and disposing the fins therewith and along the length thereof. The inlets and outlets of the tubing sections are then interconnected to form said the fluid circuit. Next, the fins are secured in place so as not become damaged during the sealing of the interconnections, which follows immediately thereafter. Finally, the entire circuit is expanded to enmesh said fins by enclosing the volume of the circuit and introducing an expansion fluid therein at a pressure which surpasses the tube yield strength of the tubing and causes the walls thereof to expand radially outward.

BRIEF DESCRIPTION OF THE DRAWINGS

Other objects and advantages of the invention will become apparent upon reading the following detailed description and upon reference to the drawings, in which.

Figure 1:
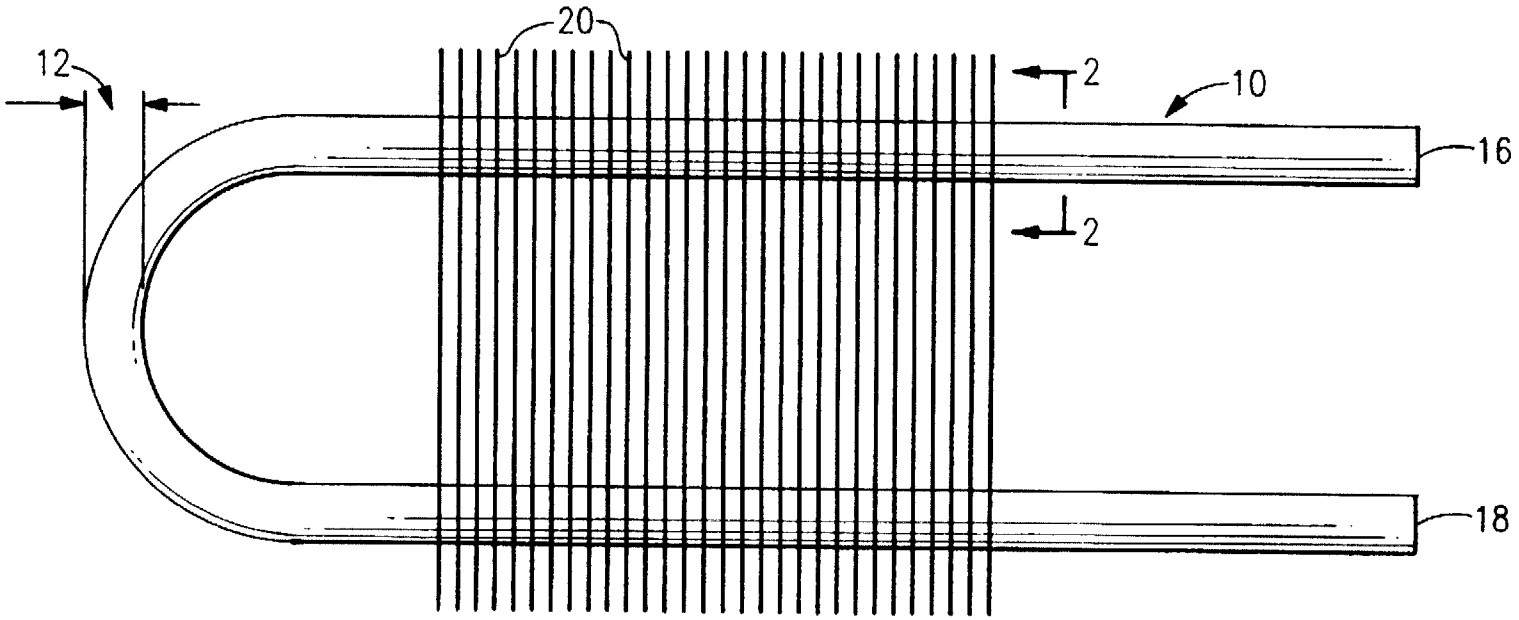
FIG. 1 is a side view of a hairpin tube for use in a HVAC style heat exchanger.

While the invention will be described in connection with a preferred procedure, it should be understood that it is not intended to limit the invention to that procedure. On the contrary, it is intended to cover all alternatives, modifications and equivalents as may be included within the spirit and scope of the invention as defined by the appended claims.

DESCRIPTION OF THE EMBODIMENT

Referring now to the drawings wherein like numerals designate corresponding parts throughout the various views, FIG. I is a side view of a heat exchanger tube 10 having had a hairpin bend 12 formed therein. The tube 10 has an inlet 16 for the intake of a heat exchanging fluid and an outlet 18 for discharge of same. Also shown in FIG. I are plate fins 20 having bores corresponding to the inlet 16 and the outlet 18 for the lacing thereof upon the tube 10.

Figure 2:
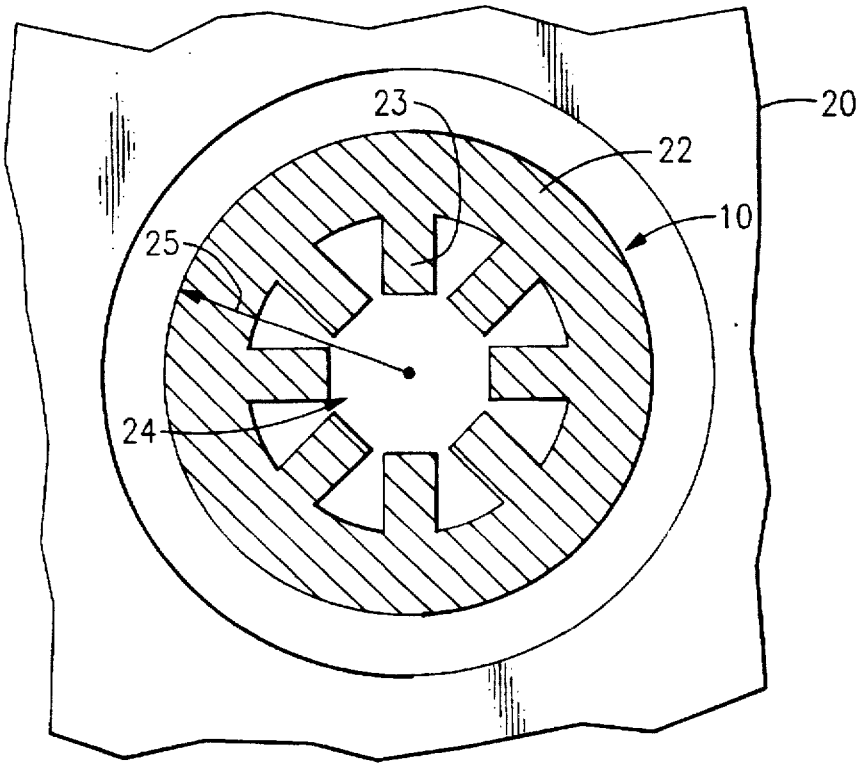
FIG. 2 is a cross-sectional axial view of the hairpin tube of FIG. 1 taken along line 22.

FIG. 2 is a cross-sectional view of the hairpin tube 10 of FIG. 1 taken along line 2—2. FIG. 2 shows the tube 10 and the fin 20 before fluidic expansion. The tube 10 has a tube wall 22 upon which is formed internal surface enhancements 23. The wall 22 and the surface enhancements 23 are formed in such a manner as to create an internal fluid flow path 24 which extends the length of tube 10. The tube 10 is magnified for illustration purposes and is depicted before expansion, when both the thickness of the wall 22 and the radius 25 of the tube 10 are at their original manufactured value. Also, FIG. 2 is a simplified illustration intended solely to explain how such tubing would expand during fluidic expansion and does not necessarily depict typical surface enhancements.

Figure 3:
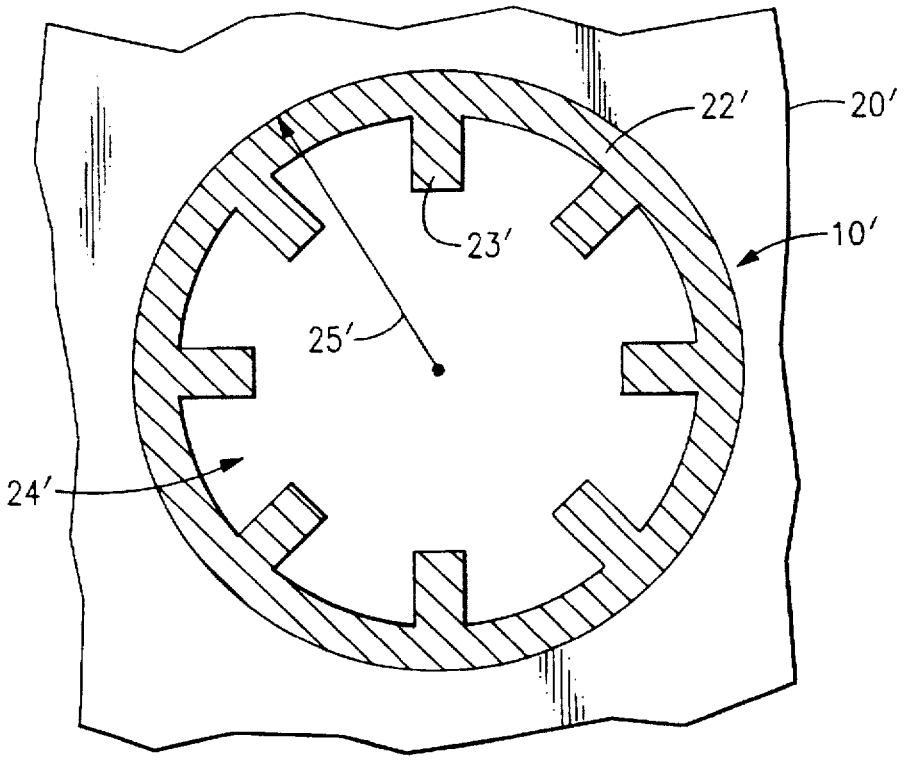
FIG. 3 is a cross-sectional axial view of the hairpin tube of FIG. 1 taken along line 2—2 after being expanded by fluid expansion.

FIG. 3 is the same view as FIG. 2 seen after the tube has been fluidically expanded. There is little or no difference between the surface enhancements 23' of FIG. 3 and the surface enhancements 23 of FIG. 2. However, the outer wall 22' thickness is slightly less than the wall 22 thickness of FIG. 3, while the radius 25' has increased with respect to the radius 25 of FIG. 2. This radial expansion causes the tube wall 22' to form a secure and conductive contact with the plate fin 20'. The diminution of the wall 22' and extension of the radius 25' is exaggerated in FIG. 3 for illustration purposes.

Figure 4:
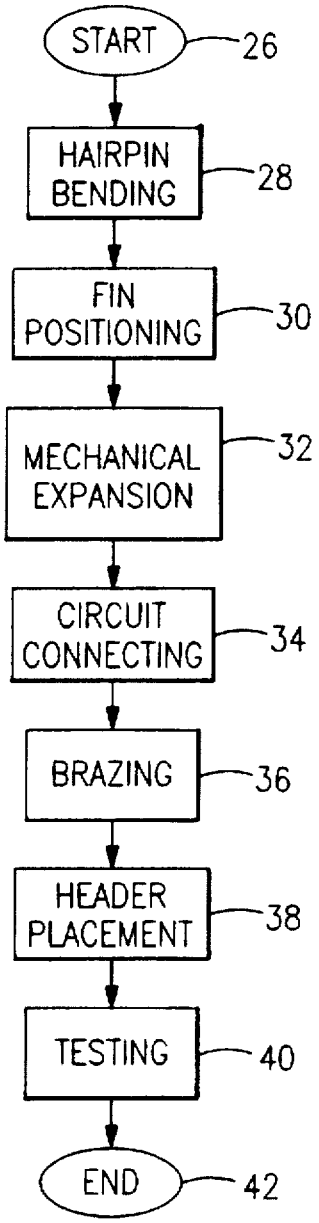
FIG.4 Prior Art
FIG. 4 is a flow diagram outlining the steps of heat exchanger construction utilizing the prior art mechanical expansion process.

FIG. 4 is a flow diagram outlining the steps of constructing a typical HVAC heat exchanger utilizing the prior art mechanical expansion process. The finished tubing, which may or may not have surface enhancements formed therein, first enters the manufacturing process at step 26. Long, straight portions of the finished tubing are bent into hairpins, as denoted by step 28. The plate fins, which provide additional surface area to the tubes and increase the heat transfer thereof, are then positioned (or "laced") on the tubes with the tube sheets, as shown step 30.

At this point, a heat exchanger is ready for mechanical expansion, which secures the fins to the tubing, as shown in step 32. Mechanical expansion is achieved by placing several mandrels of slightly larger diameter than the tubes through the open inlet and outlet portions of the hairpins and boring through the length thereof Return bends are then placed on the circuit to interconnect the inlets and outlets, thereby forming a circuit for the heat exchanging fluid, as shown at 34. Step 36 represents the brazing or sealing of these return bends to the tubes through the use of a high heat source.

Next, headers are placed on the remaining inlet and outlet portions of the hairpins not covered by return bends for adapting the heat transfer fluid from an external source throughout the heat exchanger, as depicted at 38. The finished heat exchanger must then be subjected to the additional steps of leak and proof testing, which are shown generally by step 40. The heat exchanger manufacturing is then complete, which is shown at 42.

Figure 5:
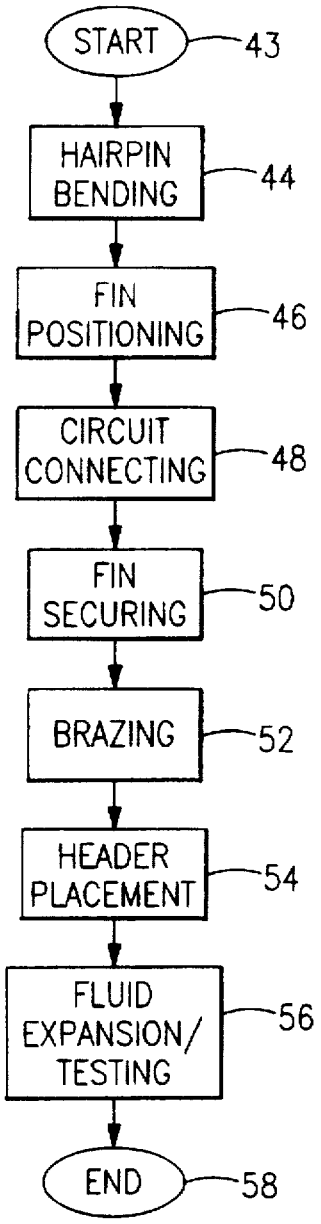
FIG. 5 is a flow diagram outlining the steps of heat exchanger construction according to the present invention.

FIG. 5 shows the manufacturing process according to the present invention. As with the prior art process shown in FIG. 4, step 43 represents entry of previously manufactured tubing into the heat exchanger construction process. Again, the tubing may or may not have surface enhancements formed therein. As with mechanical expansion, the tubing sections are first bent into hairpins, shown at 44, and the plate fins and tube sheets are then laced on the straight portions of the hairpin sections, as seen in step 46.

It is at this point that the fluid expansion process of FIG. 5 differs from the mechanical expansion process of FIG. 4 in that the entire circuit is assembled (i.e., all of the return bends are put in place), as shown at 48, before expansion takes place. The fins must be secured in place, as shown by step 50, before the return bends can be brazed on, as in step 52. The reason for securing the fins is that, unlike with the mechanical expansion process, the tubes have not yet been expanded to hold the fins in place during the brazing. The fins can be secured by fixturing the heat exchanger such that pressure is applied from the outermost fins inward, thereby holding the fins against one another and preventing them from moving.

After the brazing has been performed, the headers can be placed on the remaining inlets and outlets not covered by return bends, as depicted in step 54. Fluidic expansion and testing can then be performed, as shown in step 56. Various types of fluids can be used for performing the fluidic expansion, some examples of which are compressed air and nitrogen. These examples are not exhaustive, as other suitable fluids which would be evident to those of ordinary skill in the art would also be suitable for use with the present invention.

There are two preferred methods of performing fluid expansion, the first of which is to use a static pressure on the tube for a pre-determined duration to expand the tubing. A second method which would be more complicated and expensive, but more advantageous in certain circumstances, would be the use of dynamic pressure. Here, displacement sensors would be used to monitor the diameter of the tubing so that the pressure could be incrementally applied to the tube to obtain more accurate expansion thereof. With either method, an important difference from the mechanical process of FIG. 4 is that the proof and leak testing can be performed during this fluid expansion step. In either case, after fluidic expansion has taken place the manufacturing process is completed and the heat exchanger is ready for use, as depicted in a block 58.

Figure 6:
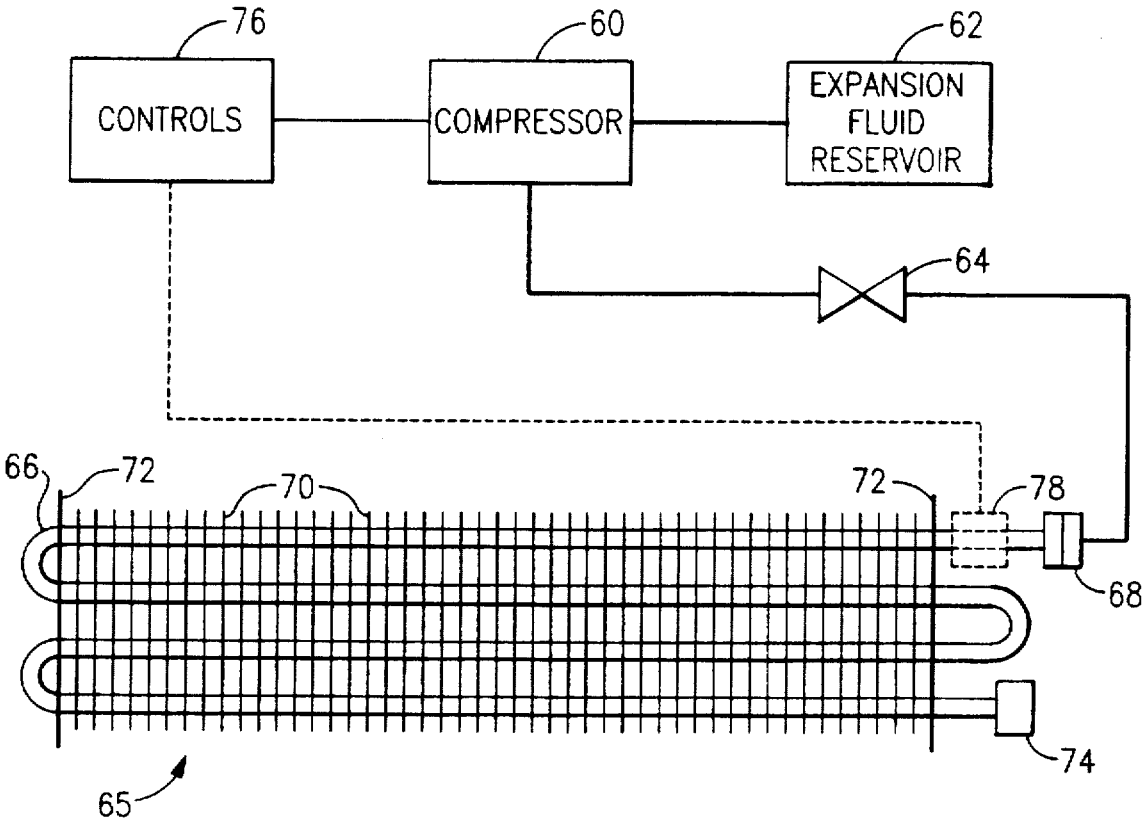
FIG. 6 is a schematic view of the fluidic expansion step of FIG. 5.

FIG. 6 is a schematic view of the fluidic expansion portion of the present invention. A compressor 60 is used to pump an expansion fluid from an expansion fluid reservoir 62 through a high pressure safety valve 64 to the heat exchanger 65. The fluid enters the tubing circuit 66 of heat exchanger 65 through a connector 68, which is sealed to the inlet of the circuit 66. The connector 68 must be a high pressure connector capable of remaining sealed while delivering a fluid at several thousand p.s.i. Upon introduction of the high pressure fluid into the circuit 66, the circuit 66 expands radially outward to form a secure contact with the plate fins 70 and tube sheets 72. In FIG. 6, a plug 74 is shown sealing the outlet of circuit 66. As an alternative, a connector similar to connector 68 could also be used in place of plug 74 to provide two points of introduction for the expansion fluid. Either method of fluid introduction would achieve similar results.

The controls 76 shown in FIG. 6 are used to govern the amount of pressure the compressor 60 supplies to the tubing 66 and to terminate the compression when sufficient expansion has been achieved. The controls 76 could be used in conjunction with a displacement sensor 78, shown in phantom. The displacement sensor 78 would physically measure the increase in tubing diameter of circuit 66 and provide feedback of the expansion progress to the controls 76. In this manner, the controls 76 could be set to stop the expansion once the circuit reaches a certain diameter or to vary the pressure of the expansion fluid during the expansion process. Such a dynamic expansion might allow for more accurate expansion of tubing. The controls 76 would consist essentially of a microprocessor programmed in such a manner as to perform these objectives.

Although the invention has been shown and described with respect to a best mode embodiment thereof, it should be understood by those skilled in the art that various changes, omissions, and additions may be made to the form and detail of the disclosed embodiment without departing from the spirit and scope of the invention as recited in the following claims.

What is claimed is:

1. A method of manufacturing a heat exchanger, the heat exchanger comprising a plurality of tubing sections interconnected to form at least one circuit for transporting a first heat transfer fluid, the tubing sections each having at least one inlet and at least one outlet, and conductive fins secured to the circuit for increasing the surface area thereof and increasing the heat transfer between the first fluid and a second fluid flowing among the fins, the method comprising the steps of:

a) positioning said tubing sections in a spaced relationship such that said fins may be placed therebetween and such that said sections are substantially parallel;

b) positioning said fins intermediate said tubing sections and along the length thereof;

c) interconnecting a plurality of said inlets and outlets of said sections to form said circuit;

d) securing said fins to prevent the movement thereof;

e) sealing said interconnections to cause said circuit to be fluid tight for transporting said first fluid; and f) expanding the entirety of said circuit to enmesh said fins by enclosing the volume of said circuit and introducing an expansion fluid therein at a pressure which surpasses the tube yield strength of said circuit and causes the tube walls thereof to expand radially outward.

2. The method of claim 1, wherein said tubing sections are hairpin bend sections.

3. The method of claim 2, wherein said fins are plate fins.

4. The method of claim 3, wherein said positioning of step b) is accomplished by lacing said hairpin sections through said plate fins to form a substantially perpendicular orientation therewith.

5. The method of claim 4, wherein before step b) said tubing sections are laced through a first tube sheet and wherein after step b) said tubing sections are laced through a second tube sheet, said tube sheets providing both stabilization of said heat exchanger and a fixture for the mounting thereof 6. The method of claim 4, wherein said interconnecting of step c) is accomplished by placing return bends upon predetermined inlets and outlets of said hairpin sections.

7. The method of claim 6, wherein said interconnecting is further accomplished by placing headers upon the inlets and outlets remaining exposed after said return bends are in place, the headers having openings corresponding to said exposed inlets and outlets and further having at least one fluid entrance and at least one fluid exit for connecting said circuit to an external source of heat exchanging fluid and facilitating the flow of said fluid into and out of said circuit.

8. The method of claim 5, wherein said securing of step d) is accomplished by applying pressure to said tube sheets, thereby causing the fins to press inward against one another.

9. The method of claim 1, wherein said sealing of step e) is accomplished by brazing said interconnections with a heat source.

10. The method of claim 7, wherein said enclosing of step f) is performed by sealingly attaching a connector to at least one of said header entrances for introducing said expansion fluid therein and sealing the remainder of said header entrances and exits with a plug.

11. The method of claim 7, wherein said enclosing of step f) is performed by sealingly attaching connectors to said header entrances and exits for introducing said expansion fluid therein.

12. The method of claim 1, wherein said expansion of step f) is accomplished by maintaining said expansion fluid at a constant pressure for a predetermined duration.

13. The method of claim 1, wherein said expansion of step f) is accomplished by varying the pressure level of said expansion fluid until said tubing has reached a predetermined level of expansion.

14. The method of claim 13, wherein during said expansion of step f) the expansion of said tubing is monitored by a displacement sensor to determine when said tubing has reached a predetermined level of expansion.

15. The method of claim 1, wherein said expansion fluid is compressed air.

16. The method of claim 1, wherein said expansion fluid is nitrogen.

17. The method of claim 1, wherein said tubing sections are rectangular tubes and said fins are serpentine fins.

18. The method of claim 17, wherein said interconnecting of step c) is accomplished by placing headers upon a plurality of said inlets and outlets, the headers having openings corresponding to said plurality of inlets and outlets and further having at least one fluid entrance and at least one fluid exit for connecting said circuit to an external source of heat exchanging fluid and facilitating the flow of said fluid into and out of said circuit.

19. The method of claim 17, wherein said securing of step d) is accomplished by brazing said fins with a high heat source.

20. The method of claim 18, wherein said enclosing of step f) is performed by sealingly attaching a connector to at least one of said header entrances for introducing said expansion fluid therein and sealing the remainder of said header entrances and exits with a plug.

21. The method of claim 18, wherein said enclosing of step f) is performed by sealingly attaching connectors to said header entrances and exits for introducing said expansion fluid therein.

22. A method of manufacturing a heat exchanger of the type having a plurality of round, conductive tubing sections formed into hairpin bends, the hairpins having at least one inlet and at least one outlet and being interconnected to form at least one circuit for transporting a first heat transfer fluid, and having conductive plate fins secured to the tubing circuit for increasing the surface area thereof, thereby increasing the heat transfer between the first fluid and a second fluid flowing among the fins, the method comprising the steps of:

a) forming said hairpin bends;

b) lacing said fins along the length of said tubing sections in a substantially perpendicular orientation therewith;

c) interconnecting a plurality of said inlets and said outlets with return bends to form said circuit;

d) securing said fins to prevent the movement thereof;

e) brazing said interconnections to sealingly connect said return bends to said hairpin sections; and f) expanding the entirety of said circuit to enmesh said fins by enclosing the volume of said circuit and introducing an expansion fluid therein at a pressure which surpasses the tube yield strength of said circuit and causes the tube walls thereof to expand radially outward.

23. The method of claim 22, wherein before step b) said hairpin sections are laced through a first tube sheet and wherein after step b) said tubing sections are laced through a second tube sheet, said tube sheets providing both stabilization of said heat exchanger and a fixture for the mounting thereof.

24. The method of claim 22, wherein said interconnecting of step c) is further accomplished by placing headers upon the inlets and outlets remaining exposed after said return bends are in place, the headers having at least one entrance and at least one exit for connecting said circuit to an external source of heat exchanging fluid and facilitating the flow of said fluid into and out of said circuit.

25. The method of claim 24, wherein said enclosing of step f) is performed by sealingly attaching a connector to at least one of said header entrances for introducing said expansion fluid therein and sealing the remainder of said header entrances and exits with a plug.

26. The method of claim 25, wherein said enclosing of step f) is performed by sealingly attaching connectors to said header entrances and exits for introducing said expansion fluid therein.

27. The method of claim 23, wherein said securing of step d) is accomplished by applying pressure to said tube sheets, thereby causing the fins to press inward against one another.

28. The method of claim 22, wherein said expansion of step c) is accomplished by maintaining said expansion fluid at a constant pressure for a predetermined duration.

29. The method of claim 22, wherein said expansion of step f) is accomplished by varying the pressure level of said expansion fluid until said tubing has reached a predetermined level of expansion.

30. The method of claim 29, wherein during said expansion of step f) the expansion of said tubing is monitored by a displacement sensor to determine when said tubing has reached a predetermined level of expansion.

31. The method of claim 22, wherein said expansion fluid is compressed air.

32. The method of claim 22, wherein said expansion fluid is nitrogen.

33. A method of manufacturing a heat exchanger of the type having a plurality of rectangular, conductive tubing sections, the sections having at least one inlet and at least one outlet and being interconnected by conductive headers, each header having openings corresponding to the inlets and outlets and further having a fluid entrance and a fluid exit, the interconnection forming at least one circuit for transporting a first heat transfer fluid, the heat exchanger further having conductive serpentine fins secured to the tubing circuit for increasing the surface area thereof and increasing the heat transfer between the first fluid and a second fluid flowing among the fins, the method comprising the steps of:

a) positioning said fins along the surface of said tubing sections such that said sections are substantially parallel;

b) interconnecting a plurality of said inlets and said outlets with said headers to form said circuit;

c) securing said fins to prevent the movement thereof; and d) expanding the entirety of said circuit to enmesh said fins by enclosing the volume of said circuit and introducing an expansion fluid therein at a pressure which surpasses the tube yield strength of said circuit and causes the tube walls thereof to expand radially outward.

34. The method of claim 33, wherein said enclosing of step d) is performed by sealingly attaching a connector to at least one of said header entrances for introducing said expansion fluid therein and sealing the remainder of said header entrances and exits with a plug.

35. The method of claim 33, wherein said enclosing of step d) is performed by sealingly attaching connectors to said header entrances and exits for introducing said expansion fluid therein.

36. The method of claim 33, wherein said expansion of step d) is accomplished by maintaining said expansion fluid at a constant pressure for a predetermined duration.

37. The method of claim 33, wherein said expansion of step d) is accomplished by varying the pressure level of said expansion fluid until said tubing has reached a predetennined level of expansion.

38. The method of claim 37, wherein during said expansion of step d) the expansion of said tubing is monitored by a displacement sensor to determine when said tubing has reached a predetermined level of expansion.

39. The method of claim 33, wherein said expansion fluid is compressed air.

40. The method of claim 33, wherein said expansion fluid is nitrogen.

* * * * *